US007032257B2

(12) United States Patent
Chen

(10) Patent No.: US 7,032,257 B2
(45) Date of Patent: Apr. 25, 2006

(54) FLUSH TANK HAVING ELECTROMAGNETIC CONTROLER

(76) Inventor: Kuan Pao Chen, P.O. Box 63-298, Taichung (TW) 406

( * ) Notice: Subject to any disclaimer, the term of this patent is extended or adjusted under 35 U.S.C. 154(b) by 96 days.

(21) Appl. No.: 10/753,681

(22) Filed: Jan. 6, 2004

(65) Prior Publication Data

US 2005/0144712 A1 Jul. 7, 2005

(51) Int. Cl.
*E03D 5/10* (2006.01)

(52) U.S. Cl. ..... 4/406; 137/389; 251/65

(58) Field of Classification Search ..... 4/378, 4/394–395, 406; 137/398; 251/65
See application file for complete search history.

(56) References Cited

U.S. PATENT DOCUMENTS 1,626,255 A * 4/1927 Roth ..... 4/406
4,353,523 A * 10/1982 Palti ..... 251/65
4,941,215 A * 7/1990 Liu ..... 4/406
5,249,313 A 10/1993 Chang ..... 4/325
5,459,885 A 10/1995 Gaw ..... 4/324
5,524,297 A 6/1996 Harrison ..... 4/325
5,527,295 A * 6/1996 Wing ..... 604/254
5,924,143 A 7/1999 Harrison ..... 4/388
6,237,165 B1 5/2001 Chen et al. ..... 4/406

* cited by examiner

*Primary Examiner*—Charles E. Phillips
(74) *Attorney, Agent, or Firm*—Charles E. Baxley

(57) ABSTRACT

A flush tank includes an outlet pipe attached to a receptacle for discharging water, a float disposed close to the outlet pipe to selectively block the outlet pipe, and to control an outward flowing of the water through the outlet pipe. A magnetically forcing device may magnetically force the float to block the outlet pipe, and a detecting device may be used to detect users and to actuate the magnetically forcing device to release the float. The magnetically forcing device includes an electromagnetic device supported by a frame to act with the float. A stop may be attached to the frame to limit a movement of the float relative to the outlet pipe.

18 Claims, 8 Drawing Sheets

FLUSH TANK HAVING ELECTROMAGNETIC CONTROLER

BACKGROUND OF THE INVENTION

1. Field of the Invention

The present invention relates to a flush tank, and more particularly to a flush tank having an electromagnetic control device for easily controlling and actuating or operating the flush tank.

2. Description of the Prior Art

Various kinds of typical flush tanks have been developed and widely used nowadays, and comprise a float movable toward an outlet pipe, in order to control the water flushing of the flush tanks, and a coupling chain coupling the float to an actuating knob, in order to control the engagement or the disengagement of the float and the outlet pipe.

For example, U.S. Pat. No. 5,249,313 to Chang, U.S. Pat. No. 5,459,885 to Gaw, U.S. Pat. No. 5,524,297 to Harrison, and U.S. Pat. No. 5,924,143 to Harrison disclose four of the typical flush tanks and also comprise a float coupled to a coupling chain which may actuate the float toward and away from the outlet pipe.

In addition, for the typical flush tanks, the float may not suitably or solidly forced to block the outlet pipe when the gasket is aged, or when the water level within the water tank is not high enough, or the like.

Furthermore, the control devices for the typical flush tanks include a mechanical mechanism and is required to be provided and attached to the flush tank, and is required to be operated manually. The mechanical operation of the mechanical mechanism may make noised while in use.

The applicant has developed a typical flush tank having an electromagnetic control device for easily controlling and actuating or operating the flush tank, and disclosed in U.S. Pat. No. 6,237,165 to Chen et al. However, the typical electromagnetic control device for the flush tank is also required to be operated manually and includes a complicated configuration.

The present invention has arisen to mitigate and/or obviate the afore-described disadvantages of the conventional flush tanks.

SUMMARY OF THE INVENTION

The primary objective of the present invention is to provide a flush tank including an electromagnetic control device for easily and automatically controlling and actuating or operating the flush tank.

In accordance with one aspect of the invention, there is provided a flush tank comprising a receptacle for receiving water therein, an outlet pipe attached to the receptacle for discharging the water, a float disposed close to the outlet pipe to selectively block the outlet pipe, and to control an outward flowing of the water through the outlet pipe. A magnetically forcing device may further be provided for magnetically forcing the float to block the outlet pipe, and a detecting device may be used to detect users and to actuate the magnetically forcing device to release the float automatically without being depressed or operated or actuated by the users.

The magnetically forcing device includes an electromagnetic device disposed in the receptacle for acting with the float. The float includes at least one projection extended therefrom for acting with the electromagnetic device. The magnetically forcing device includes a frame disposed in the receptacle to support the electromagnetic device, and for acting with the float.

The frame includes a casing provided therein to receive the electromagnetic device. The frame includes at least one block provided thereon and made of magnetically attractable material, the float includes at least one extension extended therefrom and made of magnetically attractable material for acting with the block.

A stop may further be provided and attached to the frame, for engaging with the float and for limiting a movement of the float relative to the frame. The frame includes at least one post extended therefrom, the stop includes at least one leg extended therefrom and adjustably secured to the post. The stop includes a loop attached to the leg and to slidably receive the post.

The post includes a plurality of apertures formed therein, the stop includes a catch provided on the leg to selectively engage into either of the apertures of the post, to adjustably secure the leg of the stop to the post. The leg includes a spring blade provided thereon to support the catch. The leg includes a hand grip provided on the spring blade to move the spring blade to disengage the catch from the leg.

The electromagnetic device includes a core for acting with the float, and a coil disposed around the core, to move the core relative to the coil. The electromagnetic device includes a housing to receive the core and the coil. The electromagnetic device includes a duct to receive the core. The duct includes a cushioning member disposed therein to engage with and to cushion the core.

The electromagnetic device includes a container having a cavity formed therein to slidably receive the core. A knob may further be provided and attached to the receptacle, and a chain coupled between the knob and the float.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
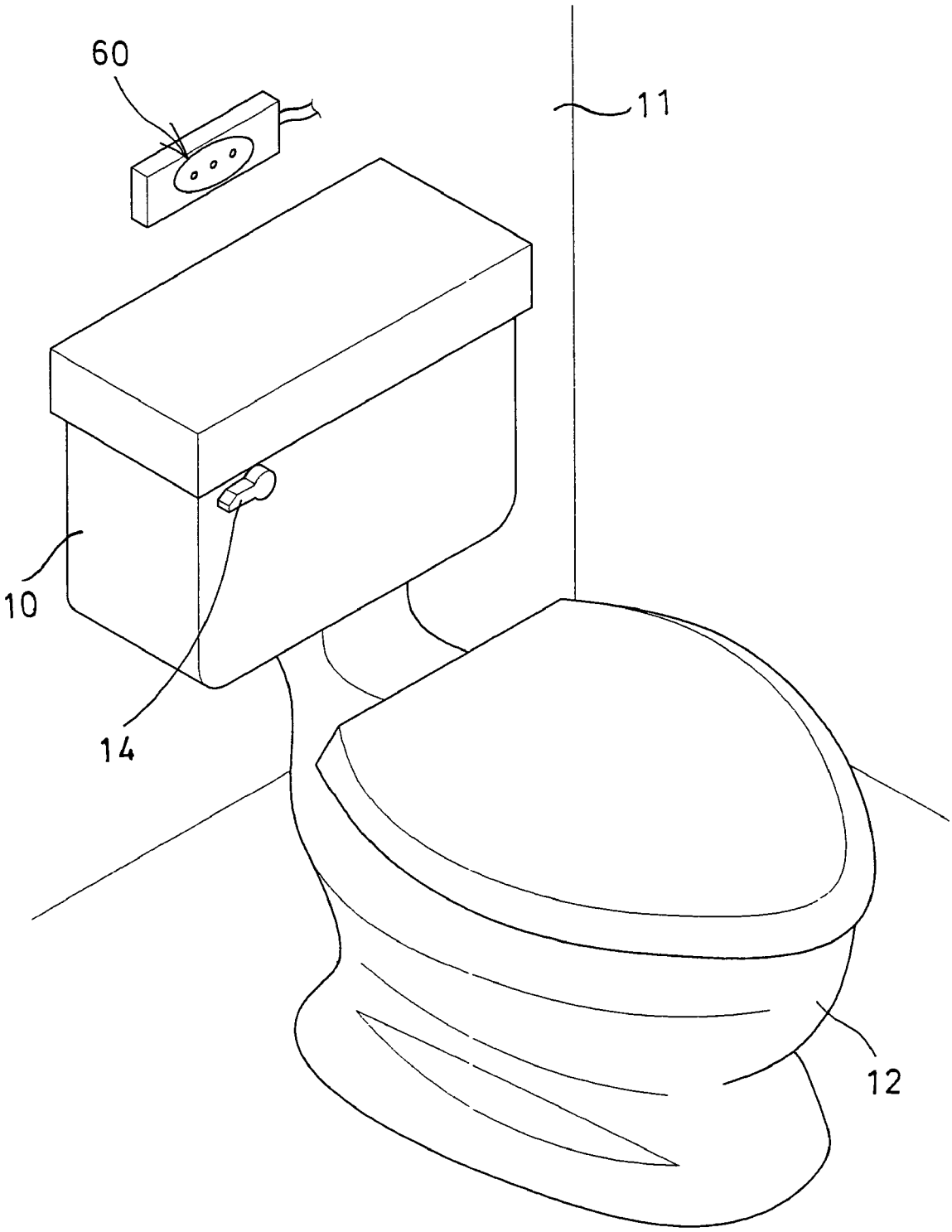
FIG. 1 is a perspective view of a flush tank in accordance with the present invention.
Figure 2:
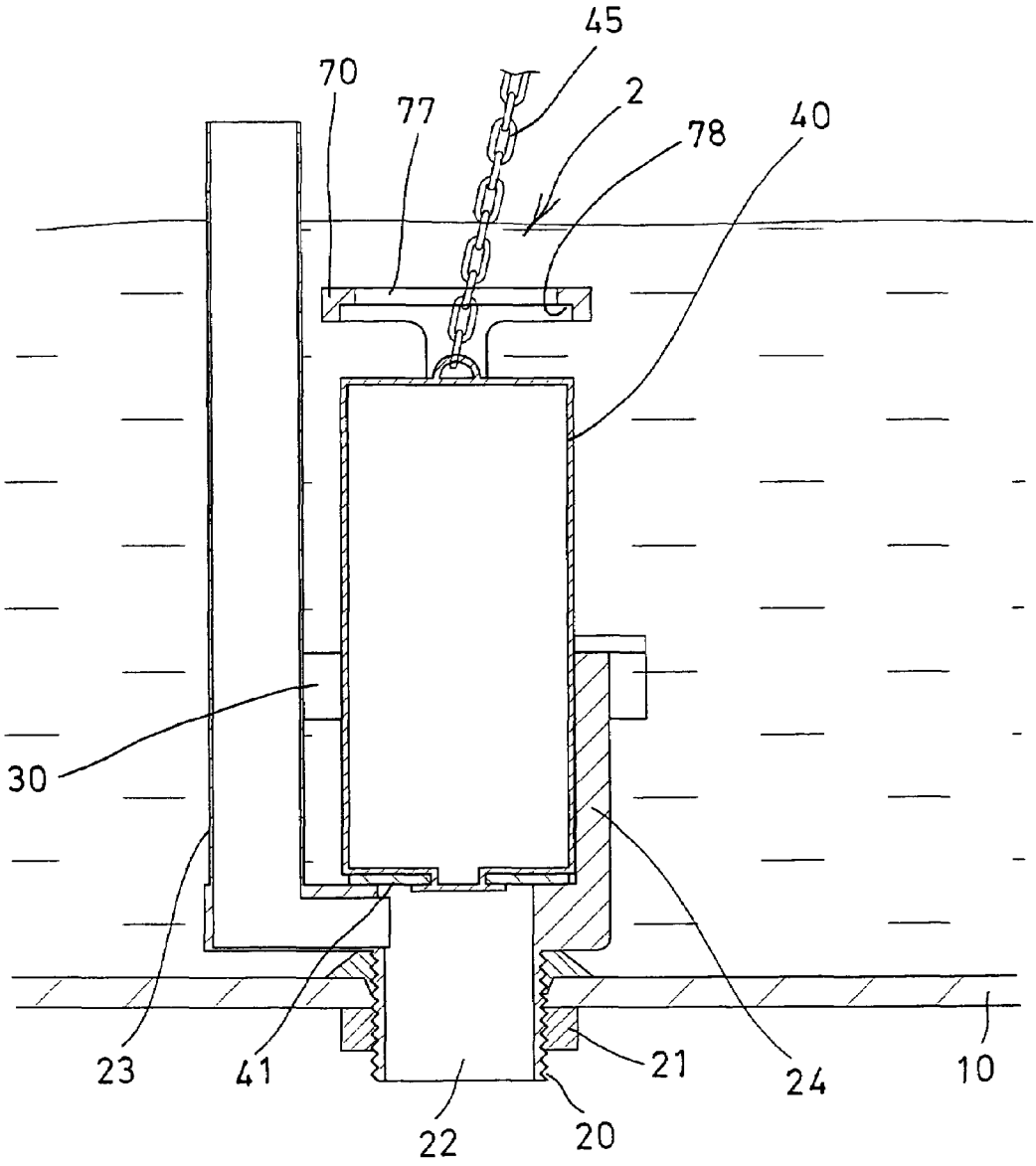
FIG. 2 is a partial cross sectional view illustrating the control device of the flush tank.

Referring to the drawings, and initially to FIGS. 1 and 2, a flush tank in accordance with the present invention includes a receptacle 10 normally attached to a wall member 11, and disposed above the rear portion of a toilet 12, for receiving water to flush the toilet 12. The receptacle 10 comprises a usual actuating knob 14 attached thereto, for controlling the flushing of the toilet 12.

As shown in FIGS. 2–4 and 9, an outlet pipe 20 is normally attached or secured to the bottom portion of the receptacle 10 with one or more fasteners 21, and includes a passage 22 formed therein for allowing the water contained in the receptacle 10 to flow out and to flush of the toilet 12 or for discharging the water. A usual overflow tube 23 is attached to the outlet pipe 20 to maintain a water level of the receptacle 10.

A frame 30 is attached or secured to the receptacle 10, such as secured to the outlet pipe 20 of the receptacle 10 with one or more stays 24, and includes a space 31 formed therein to slidably receive a float 40 therein. The float 40 is disposed above or close to the outlet pipe 20 and includes a pad 41 attached to the bottom thereof, for engaging with the outlet pipe 20, to control the water outward flowing through the outlet pipe 20.

The frame 30 includes one or more, such as two blocks 32 provided thereon or extended therefrom, and made of metal or magnetic members or magnetically attractable materials for magnetically attracting purposes. The frame 30 further includes one or more, such as two blocks or casings 33 provided thereon or extended therefrom, and each having a chamber 34 formed therein (FIGS. 5, 7, 8) to receive an electromagnetic device 50 therein.

Figure 7:
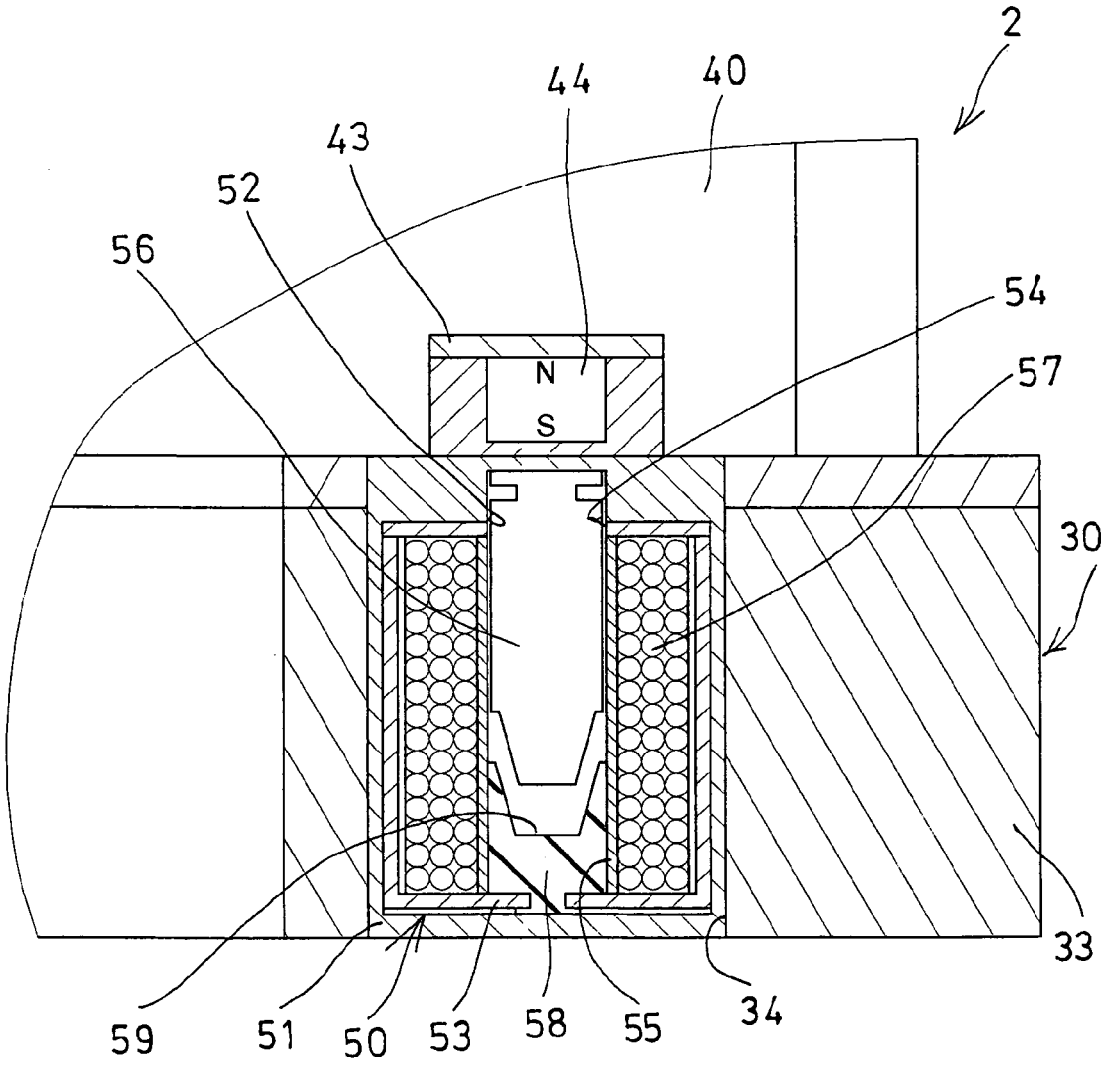
FIG. 7 is a partial cross sectional view taken along lines 7—7 of FIG. 3.
Figure 8:
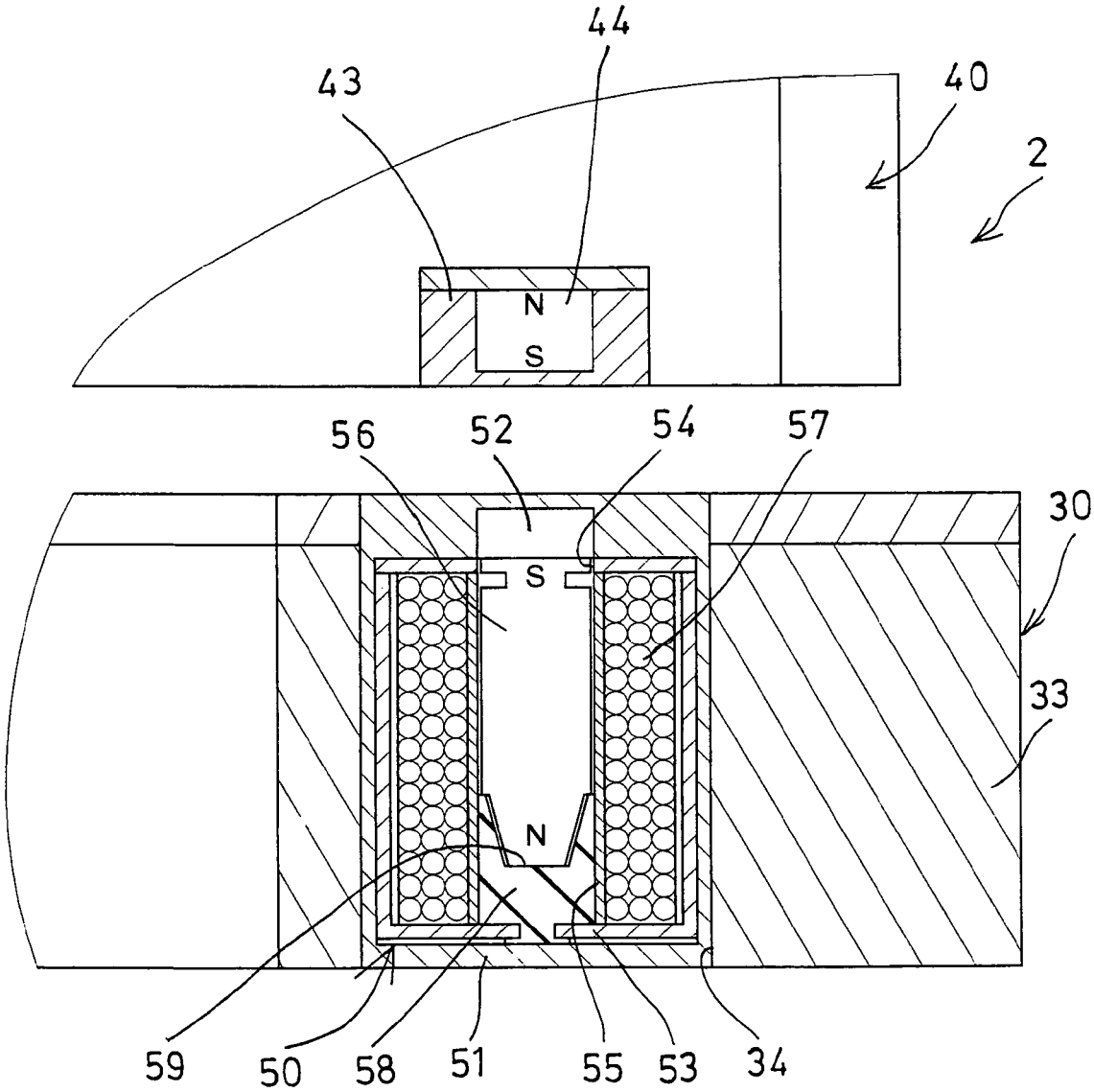
FIG. 8 is a partial cross sectional view similar to FIG. 7; illustrating the operation of the control device for the flush tank.

As shown in FIGS. 7 and 8, each of the electromagnetic devices 50 includes a container 51 engaged into the chamber 34 of the corresponding casing 33 and having a cavity 52 formed therein, such as formed in the upper portion thereof. A housing 53 is engaged in the container 51 and includes an orifice 54 formed in the upper portion thereof and communicating with the cavity 52 of the container 51.

Each of the electromagnetic devices 50 includes a duct 55 disposed in the housing 53, a core 56 slidably received in the duct 55 and having an upper portion movable or engageable into the cavity 52 of the container 51, and a coil 57 engaged around the core 56 or the duct 55, for actuating the core 56 to move relative to the duct 55 and the housing 53 or the container 51.

It is preferable that a resilient or cushioning member 58 is disposed in the lower portion of the duct 55, and includes a depression 59 formed therein, to slidably receive the lower portion of the core 56, and to cushion the core 56, and to prevent the core 56 from impacting or hammering into the housing 53 or the container 51.

The float 40 includes one or more, such as two extensions 42 provided thereon or extended therefrom, and made of magnetic members or magnetically attractable materials or metal for magnetically attracting or acting with the corresponding blocks 32 of the frame 30. However, the magnetically attracting force between the extensions 42 of the float 40 and the blocks 32 of the frame 30 is smaller than the floating force or the buoyancy of the float 40.

The float 40 further includes one or more, such as two projections 43 provided thereon or extended therefrom, and made of magnetic members or magnetically attractable materials or metal, or having a magnet 44, such as a permanent magnet 44 disposed therein for magnetically attracting or acting with the electromagnetic device 50. For example, when the electromagnetic device 50 is not energized, the magnetic core 56 of the electromagnetic device 50 may act with or may attract the projections 43 or the magnets 44 of the float 40 (FIG. 7).

When the magnetic core 56 of the electromagnetic device 50 is acted with or attracted the projections 43 of the float 40, and when the extensions 42 of the float 40 are also acted with the blocks 32 of the frame 30, the magnetically attracting force between the extensions 42 and the blocks 32, and between the core 56 and the projections 43 is arranged to be greater than the floating force or the buoyancy of the float 40, in order to force the float 40 downwardly to block the outlet pipe 20 (FIG. 2).

The flush tank further includes a sensor or detecting device 60 (FIG. 1) attached to the wall member 11, and preferably disposed above or close to the rear portion of the toilet 12, for detecting whether the users are using the toilet 12 or not. The detecting device 60 is electrically coupled to the electromagnetic devices 50, with such as wires 61 (FIGS. 3, 4), for actuating the electromagnetic devices 50.

Figure 5:
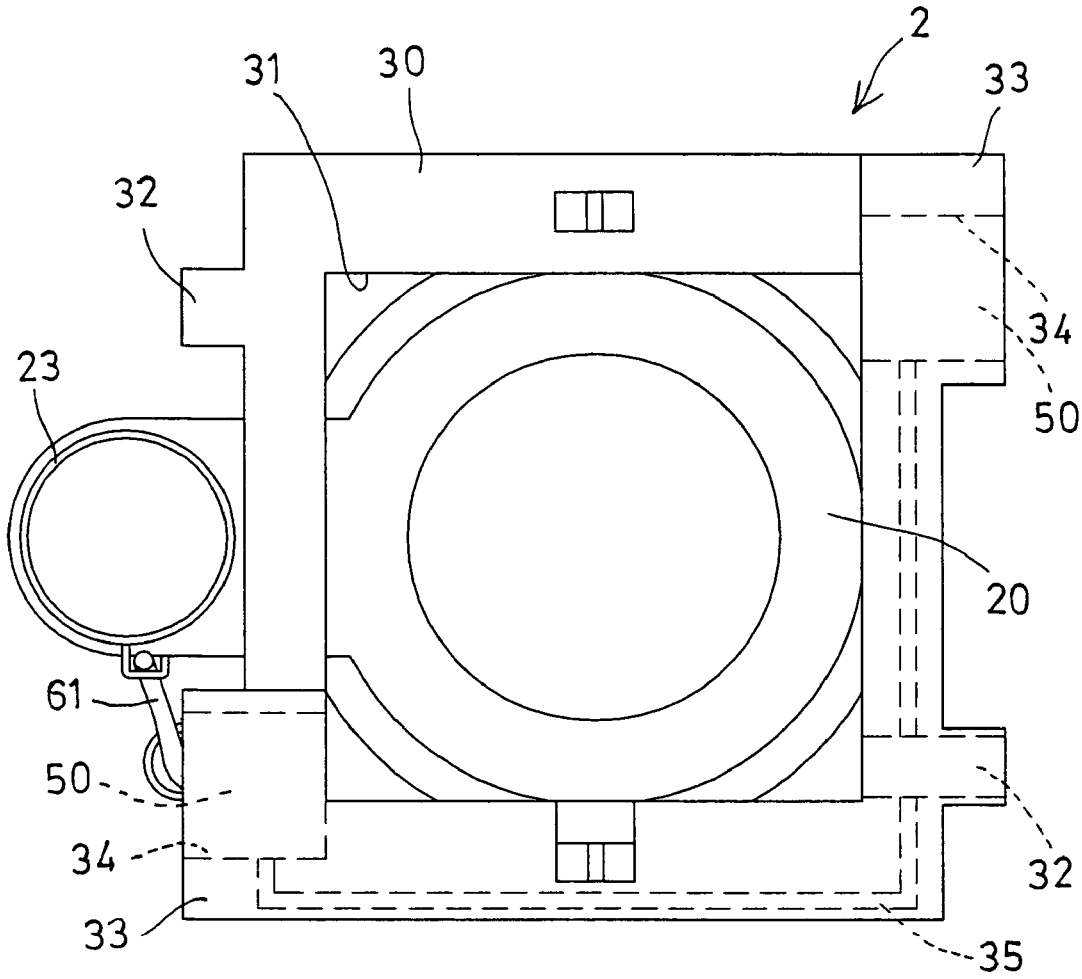
FIG. 5 is a top plan view of the control device for the flush tank.
Figure 6:
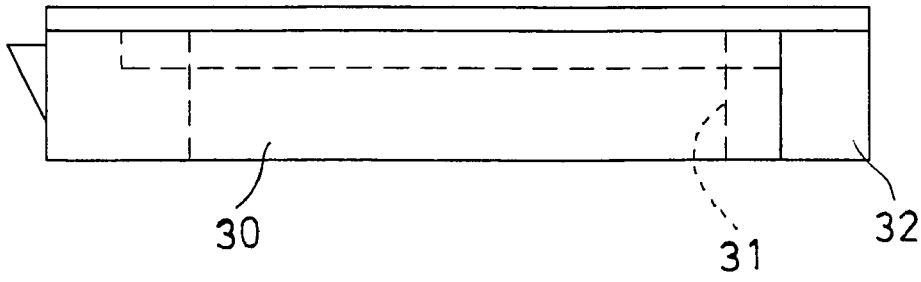
FIG. 6 is a partial side plan view of the control device for the flush tank.

For example, when the detecting device 60 has detected that a user is using the toilet 12, the electromagnetic devices 50 may be actuated to force or to pull the core 56 into the duct 55, and thus to separate the core 56 from the projections 43 or the magnets 44 of the float 40 (FIG. 8). As shown in FIG. 5, the frame 30 may include one or more pathways 35 formed therein to receive the wires 61.

Figure 9:
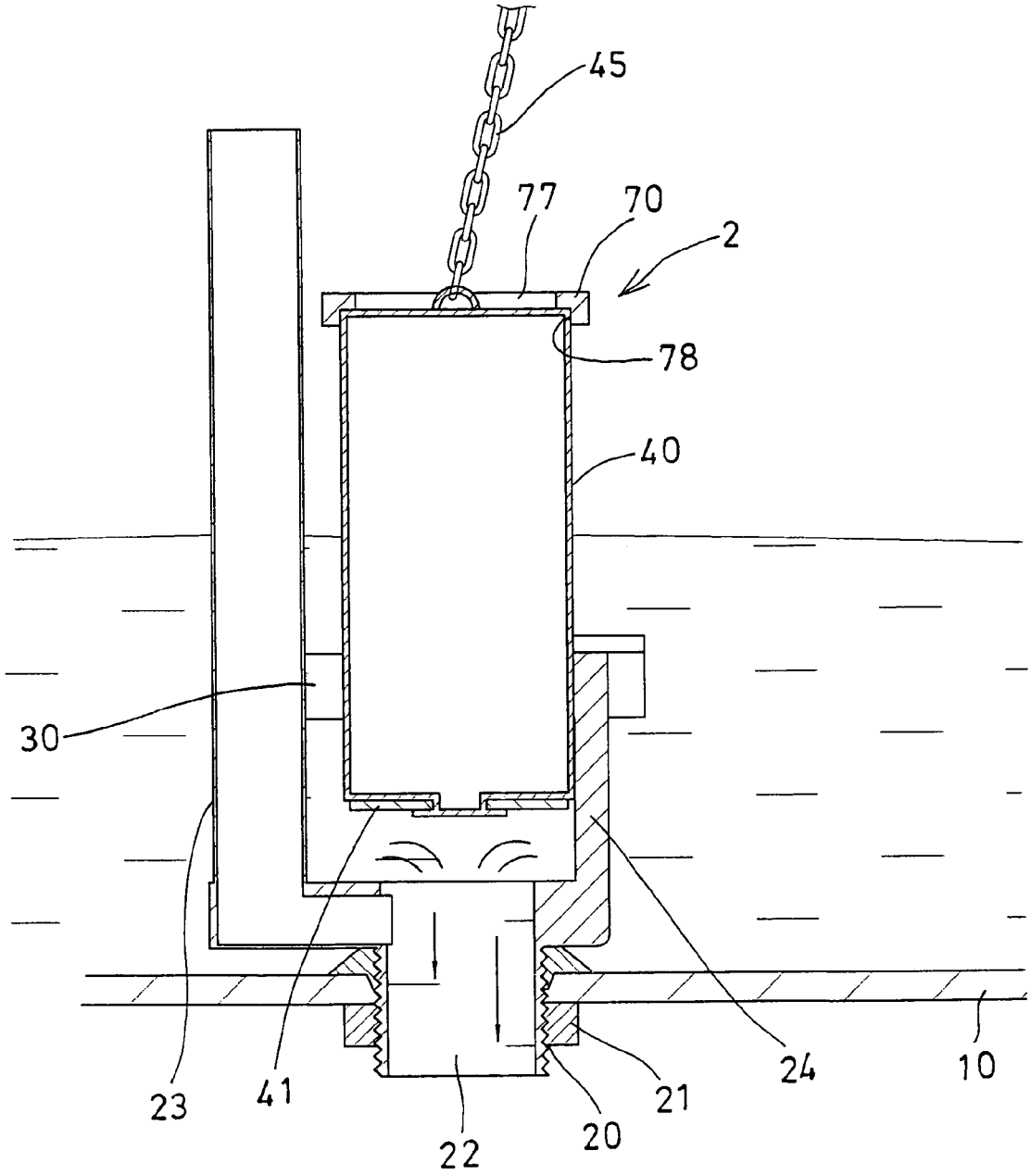
FIG. 9 is a partial cross sectional view similar to FIG. 2; illustrating the operation of the control device for the flush tank.

When the core 56 is separated from the projections 43 or the magnets 44 of the float 40, the magnetically attracting force between the extensions 42 of the float 40 and the blocks 32 of the frame 30 is smaller than the floating force or the buoyancy of the float 40, and is thus not good enough to force the float 40 downwardly to block the outlet pipe 20. At this moment, the float 40 may float upwardly away from the outlet pipe 20 (FIG. 8), to allow the water in the receptacle 10 to flow out through the outlet pipe 20 and to flush the toilet 12 (FIG. 9).

It is preferable that the core 56 may be formed into different polarity from that of the magnet 44 when the core 56 is separated from the projections 43 or the magnets 44 of the float 40, or when the core 56 is forced into the duct 55 by the coil 57, in order to further force the magnet 44 and the float 40 upwardly away from the frame 30 and the electromagnetic devices 50.

After the water flushing operation, the float 40 may move downwardly to block the outlet pipe 20 again. The electromagnetic devices 50 may be switched off or de-energized when the float 40 floats upwardly away from the outlet pipe 20 to conduct the water flushing operation. At this moment, the core 56 is not acted by the coil 57, and may be attracted to the magnet 44, to solidly retain the float 40 to the frame 30, and to solidly block the outlet pipe 20 again.

Figure 3:
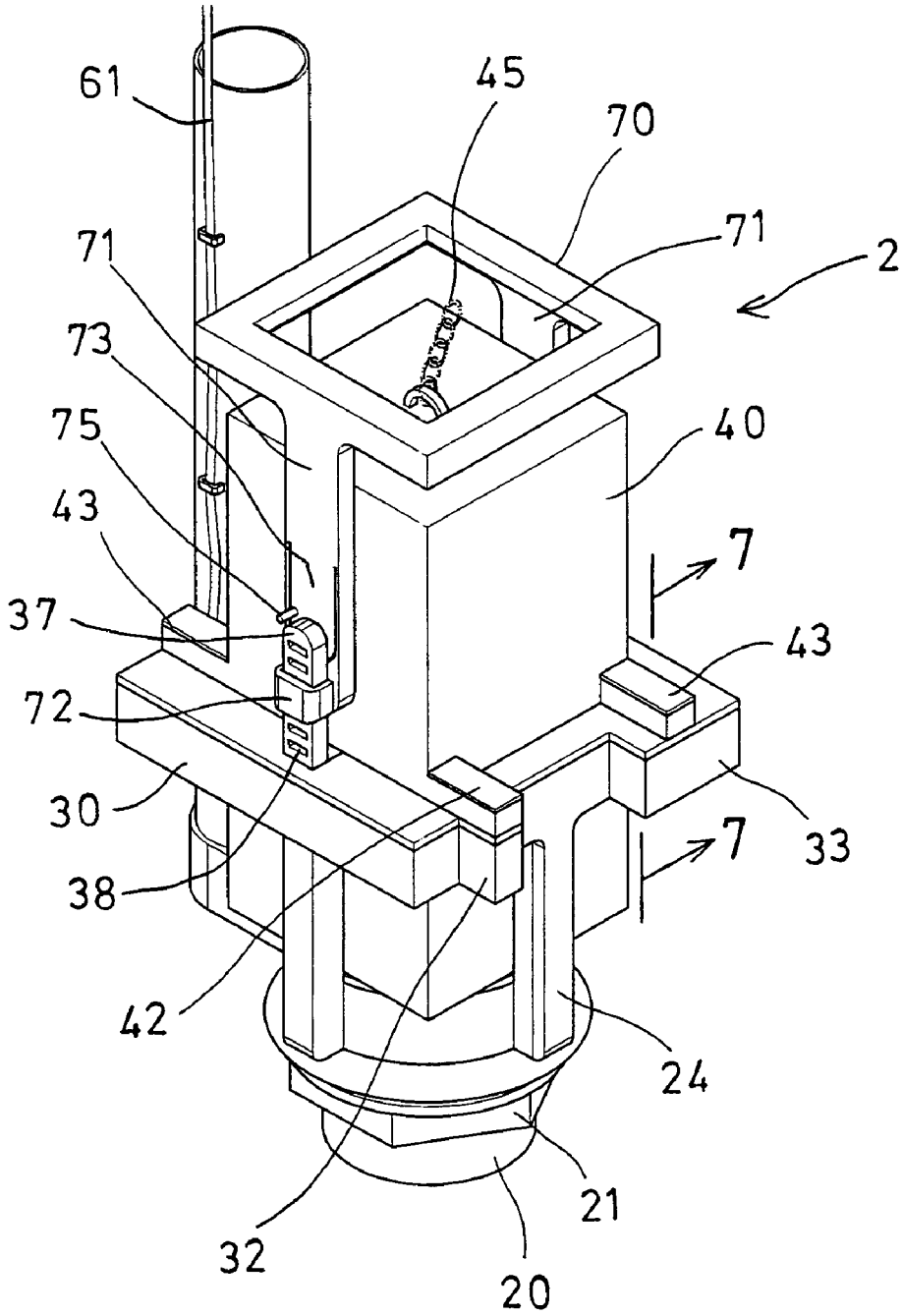
FIG. 3 is a perspective view of the control device for the flush tank.
Figure 4:
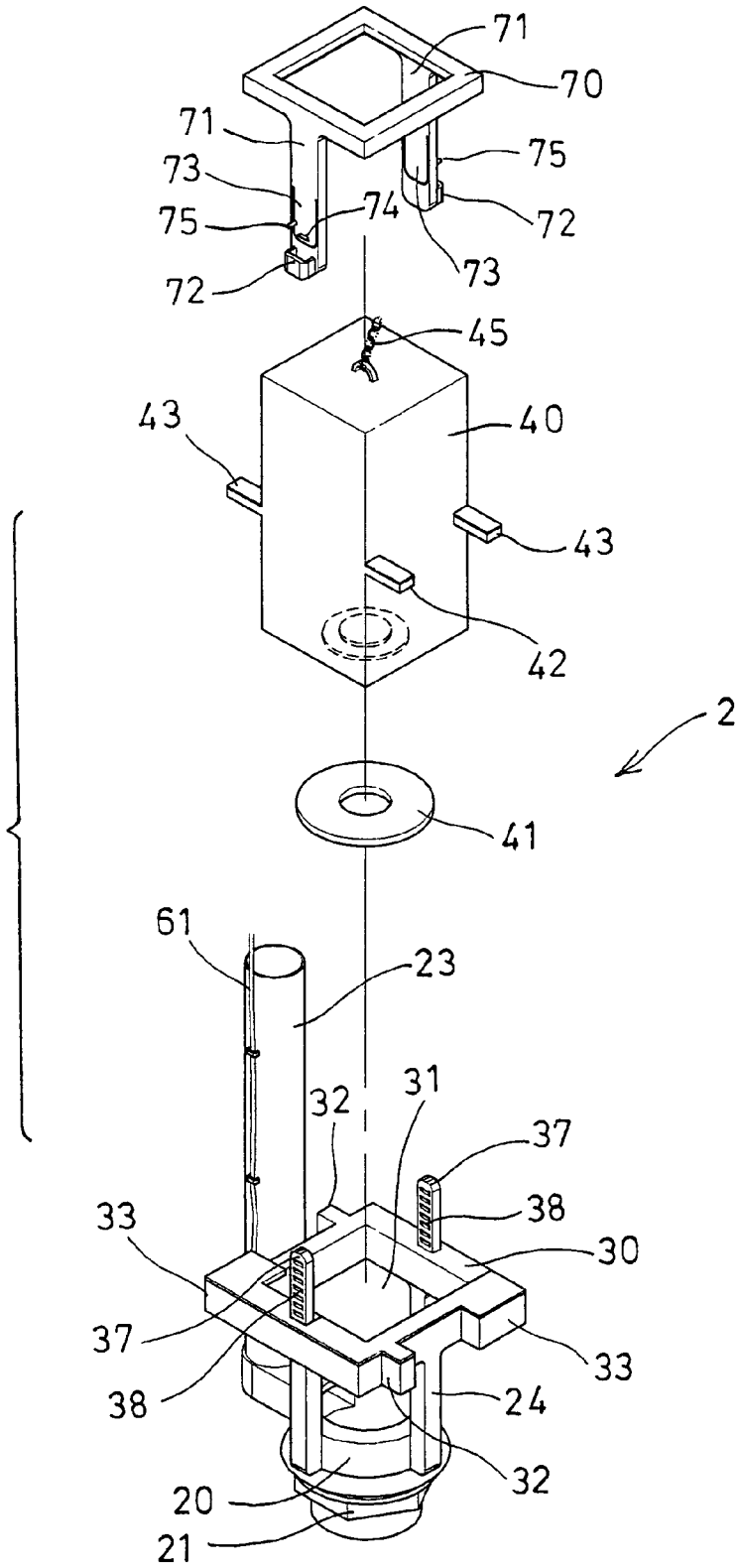
FIG. 4 is a partial exploded view of the control device for the flush tank.

As shown in FIGS. 2–4, a usual pull chain 45 may further be provided and coupled between the float 40 and the actuating knob 14 (FIG. 1), to allow the float 40 to be pulled and disengaged from the outlet pipe 20 manually by the users, and to allow the toilet 12 to be flushed by the water when the float 40 is pulled disengaged from the outlet pipe 20.

As shown in FIGS. 3 and 4, the frame 30 may further include one or more, such as two posts 37 extended therefrom and each having one or more apertures 38 formed therein, and may further include a stop 70 adjustably secured thereto. For example, the stop 70 includes one or more, such as two legs 71 extended therefrom and each having a loop 72 provided thereon to slidably receive the posts 37, and to slidably secure the stop 70 to the frame 30.

The stop 70 includes one or more, such as two spring blades 73 formed in the legs 71 thereof respectively, and each having a catch 74 extended therefrom (FIG. 4), for engaging into the corresponding apertures 38 of the posts 37, and thus to adjustably secure the stop 70 to the posts 37 of the frame 30. Each of the spring blades 73 may include a hand grip 75 extended therefrom, for pushing the spring blades 73 to disengage the catches 74 from the apertures 38 of the posts 37, and thus to allow the legs 71 of the stop 70 to be slid and adjusted up and down along the posts 37.

The stop 70 includes an opening 77 formed therein for receiving the usual pull chain 45, and includes an inner peripheral shoulder 78 formed therein (FIGS. 2, 9) for receiving the upper portion of the float 40, and for limiting the movement of the float 40 relative to the frame 30.

It is to be noted that the float 40 is allowed to be automatically floated or moved upwardly away from the outlet pipe 20 to allow the water in the receptacle 10 to flow out through the outlet pipe 20 and to flush the toilet 12 when the detecting device 60 has detected that a user is using the toilet 12, such as when the user has been detected to use the toilet 12 and then moved away from the toilet 12. The typical electromagnetic control devices for the flush tanks are still required to be operated manually.

In addition, the electromagnetic device 50 and the magnet 44 may be enclosed or shielded or covered or protected with plastic materials, to prevent the electromagnetic device 50 and the magnet 44 from being rusted. In addition, the core 56 is received in the container 51 and the housing 53, and will not make noises while moving relative to the duct 55. No typical flush tanks have a magnetically attracting device to force the float to block the outlet pipe.

Accordingly, the flush tank in accordance with the present invention includes an electromagnetic control device for easily and automatically controlling and actuating or operating the flush tank.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flush tank comprising:

a receptacle for receiving water therein, an outlet pipe attached to said receptacle for discharging the water, a float disposed close to said outlet pipe to selectively block said outlet pipe, and to control an outward flowing of the water through said outlet pipe, and magnetically forcing means for magnetically forcing said float to block said outlet pipe, said magnetically forcing means including an electromagnetic device disposed in said receptacle for acting with said float, and said float including at least one projection extended therefrom for acting with said electromagnetic device.

2. The flush tank as claimed in claim 1 further comprising a knob attached to said receptacle, and a chain coupled between said knob and said float.

3. The flush tank as claimed in claim 1 further comprising a detecting device to detect users and to actuate said magnetically forcing means to release said float.

4. The flush tank as claimed in claim 1, wherein said magnetically forcing means includes a frame disposed in said receptacle to support said electromagnetic device, and for acting with said float.

5. The flush tank as claimed in claim 4, wherein said frame includes a casing provided therein to receive said electromagnetic device.

6. The flush tank as claimed in claim 4, wherein said frame includes at least one block provided thereon and made of magnetically attractable material, said float includes at least one extension extended therefrom and made of magnetically attractable material for acting with said at least one block.

7. The flush tank as claimed in claim 4 further comprising a stop attached to said frame, for engaging with said float and for limiting a movement of said float relative to said frame.

8. The flush tank as claimed in claim 7, wherein said frame includes at least one post extended therefrom, said stop includes at least one leg extended therefrom and adjustably secured to said at least one post.

9. The flush tank as claimed in claim 8, wherein said stop includes a loop attached to said at least one leg and to slidably receive said at least one post.

10. The flush tank as claimed in claim 8, wherein said at least one post includes a plurality of apertures formed therein, said stop includes a catch provided on said at least one leg to selectively engage into either of said apertures of said at least one post, to adjustably secure said at least one leg of said stop to said at least one post.

11. The flush tank as claimed in claim 10, wherein said at least one leg includes a spring blade provided thereon to support said catch.

12. The flush tank as claimed in claim 11, wherein said at least one leg includes a hand grip provided on said spring blade to move said spring blade to disengage said catch from said at least one leg.

13. The flush tank as claimed in claim 1, wherein said electromagnetic device includes a core for acting with said float, and a coil disposed around said core, to move said core relative to said coil.

14. The flush tank as claimed in claim 13, wherein said electromagnetic device includes a housing to receive said core and said coil.

15. The flush tank as claimed in claim 13, wherein said electromagnetic device includes a duct to receive said core.

16. The flush tank as claimed in claim 13, wherein said electromagnetic device includes a container having a cavity formed therein to slidably receive said core.

17. A flush tank comprising:

a receptacle for receiving water therein, an outlet pipe attached to said receptacle for discharging the water, a float disposed close to said outlet pipe to selectively block said outlet pipe, and to control an outward flowing of the water through said outlet pipe, and magnetically forcing means for magnetically forcing said float to block said outlet pipe, said magnetically forcing means including an electromagnetic device disposed in said receptacle for acting with said float, and said electromagnetic device including a core for acting with said float, and a coil disposed around said core, to move said core relative to said coil, and said electromagnetic device including a duct to receive said core, said duct including a cushioning member disposed therein to engage with and to cushion said core.

18. A flush tank comprising:

a receptacle for receiving water therein, an outlet pipe attached to said receptacle for discharging the water, a float disposed close to said outlet pipe to selectively block said outlet pipe, and to control an outward flowing of the water through said outlet pipe, and magnetically forcing means for magnetically forcing said float to block said outlet pipe, said magnetically forcing means including an electromagnetic device disposed in said receptacle for acting with said float, and said float including a magnet engaged therein for acting with said electromagnetic device.

* * * * *